US011363886B2

(12) United States Patent
Johnson

(10) Patent No.: US 11,363,886 B2
(45) Date of Patent: Jun. 21, 2022

(54) MECHANISM FOR ACTUATING MOTION FURNITURE

(71) Applicant: VIP LUXURY SEATING LLC, New Albany, MS (US)

(72) Inventor: Terry Dale Johnson, Baldwyn, MS (US)

(73) Assignee: VIP LUXURY SEATING LLC, New Albany, MS (US)

( * ) Notice: Subject to any disclaimer, the term of this patent is extended or adjusted under 35 U.S.C. 154(b) by 58 days.

(21) Appl. No.: 16/724,121

(22) Filed: Dec. 20, 2019

(65) Prior Publication Data

US 2020/0196759 A1 Jun. 25, 2020

Related U.S. Application Data

(60) Provisional application No. 62/784,348, filed on Dec. 21, 2018.

(51) Int. Cl.
*A47C 1/034* (2006.01)

(52) U.S. Cl.
CPC ..... *A47C 1/034* (2013.01)

(58) Field of Classification Search
CPC .. A47C 1/0355; A47C 1/0345; B64D 11/0643
USPC ..... 297/84–91
See application file for complete search history.

(56) References Cited

U.S. PATENT DOCUMENTS 7,673,933 B2 * 3/2010 Lawson ..... A47C 1/0345 297/69
2006/0061148 A1 * 3/2006 Pollard ..... A47C 31/008 297/85 M
2010/0253129 A1 * 10/2010 Dowty ..... B64D 11/06395 297/85 M
2012/0299363 A1 * 11/2012 Crum ..... A47C 1/0352 297/85 M

* cited by examiner

*Primary Examiner* — Sarah B McPartlin
(74) *Attorney, Agent, or Firm* — Law Offices of Steven W. Weinrieb

(57) ABSTRACT

A mechanism for actuating a motion furniture is disclosed. The mechanism includes a chassis assembly, a linkage assembly operatively connected to the chassis assembly via a front pivot link and a rear pivot link and further including an ottoman drive link, and a linear actuator having a base and a driving end, the base being connected to the chassis and the driving end being operatively connected to the linkage assembly via the ottoman drive link, wherein the linear actuator is configured to extend to deploy the linkage assembly to an open position by pushing the ottoman drive link forward and to contract to retract the linkable assembly to a closed position by pulling the motor drive tube backward.

15 Claims, 5 Drawing Sheets

MECHANISM FOR ACTUATING MOTION FURNITURE

CROSS-REFERENCE TO RELATED APPLICATIONS

This application claims the benefit of U.S. Provisional Application 62/784,348, filed Dec. 21, 2018 the entirety of which is herein incorporated by reference.

FIELD OF THE INVENTION

Embodiments of the present invention relate to motion furniture. Specifically, embodiments of the present invention relate to mechanisms and methods for opening and closing motion furniture.

BACKGROUND

Motion furniture that recline and/or deploy are well-known. Typically, the motion furniture includes a vertical back member and a seat member operatively connected to the back member. The back member is generally fixed to the seating member usually by a stanchion secured to the floor. The seat member and the back member are also connected to a pair of armrests. The back member may be configured to recline (i.e., pivot away from the seating member) when a motion mechanism of the chair is actuated. Further, an ottoman assembly retracted under the seating member may be deployed when the motion mechanism is actuated. Examples of motion furniture include reclining chairs and movie theater chairs.

FIG. 1A illustrates a perspective view of an exemplary motion furniture 100 comprising a mechanism 300 for actuating the motion furniture between a first configuration and a second configuration in an example. FIG. 1B illustrates a front view of an exemplary motion furniture 100 comprising a mechanism 300 for actuating the motion furniture between a first configuration and a second configuration in an example. FIG. 1C illustrates a side view of an exemplary motion furniture 100 comprising a mechanism 300 for actuating the motion furniture between a first configuration and a second configuration in an example. The motion furniture 100 illustrated in FIGS. 1A-C may be a reclining chair, such as used in living rooms or movie theaters.

FIG. 2A illustrates a closed position of a full assembly of an existing mechanism 200 for actuating a motion furniture between a first configuration and a second configuration. The mechanism 200 comprises an actuator 10. In some embodiment, the actuator 10 may be a linear actuator. The linear actuator 10 is an elongated assembly comprising a base 11 at one end and a driving end 12 at an opposite end of the actuator 10. The linear actuator 10 may be a mechanical actuator, an electrical actuator, a hydraulic actuator, or a pneumatic actuator, among other examples, including combination of the above (e.g., an electromechanical actuator). The mechanism 200 further comprises a linkage assembly 210. The linkable assembly 210 is a set of inter-connected components that transmits the motion of the actuator 10 to an ottoman assembly 250 to deploy or retract the ottoman assembly 250. The base 11 of the actuator 10 is rigidly attached to a fixed point of the linkage assembly 210. The base 11 of the actuator 10 may be secured to the linked assembly 210 using a variety of fasteners such as screws, etc. The driving end 12 of the actuator 10 is connected to a driving point such as a rear motor drive tube. The rear motor drive tube is in turn attached to a rear pivot link 30 of the linkage assembly 210. FIG. 2B illustrates the linkage assembly 210 of the existing mechanism 200 in a closed position. The linear actuator 10 is omitted to provide a cleaner view of the linkage assembly 210 and, in particular, of the connection points of the linear actuator 10 at the fixed point of the assembly 210 and at the rear motor drive tube, as previously described. When the linkage assembly 210 is in the closed position as illustrated, the linear actuator 10 is fully extended. To move the linkage assembly 210 to the open position, the linear actuator 10 retracts, as described below.

FIG. 3A illustrates an open position of a full assembly of the existing mechanism 200 for actuating a motion furniture between a first configuration and a second configuration. Unlike in FIGS. 2A and 2B, the linear actuator 10 is contracted, which pulls the driving point and the rear motor drive tube to which it is attached toward the base of the actuator 10, causing the rear pivot link 30 to pivot and the linkage assembly 210 to open. FIG. 3B illustrates the linkage assembly 210 of the existing mechanism 200 in an open position without the actuator 10 to provide a cleaner view of the open position of the existing mechanism.

In view of the above described existing mechanisms, it is desirable to provide an improved mechanism for actuating a motion furniture between a first configuration and a second configuration that improves the drive characteristic of the mechanism by controlling the linkage closer to the center of the linkage arrangement. It is further desired to provide an improved mechanism that decreases the electrical load on the linear actuator, provides power savings, and improves the longevity of the actuator.

SUMMARY OF THE INVENTION

A mechanism for actuating a motion furniture is disclosed. The mechanism includes a chassis assembly, a linkage assembly operatively connected to the chassis assembly via a front pivot link and a rear pivot link and further including an ottoman drive link, and a linear actuator having a base and a driving end, the base being connected to the chassis and the driving end being operatively connected to the linkage assembly via the ottoman drive link, wherein the linear actuator is configured to extend to deploy the linkage assembly to an open position by pushing the ottoman drive link forward and to contract to retract the linkable assembly to a closed position by pulling the motor drive tube backward.

In some embodiments, the linkage assembly is operatively coupled to an ottoman assembly, the linkage assembly retracting the ottoman assembly in the closed position and deploying the ottoman assembly in the open position. In some of these embodiments, the linkage assembly further includes an ottoman link connecting the linkage assembly to the ottoman assembly, the linear actuator actuating the ottoman link via the ottoman drive link.

In certain embodiments, the linkage assembly includes a seat rail, the front pivot link being pivotably connected to the front of the seat rail and the rear pivot link being rotatably connected to the rear of the seat rail. In some of these embodiments, the linkage assembly further includes a bell crank connected to the seat rail, a first arm of the bell crank mechanically connected to the ottoman link and a second arm of the bell crank mechanically connected to the rear pivot link. In certain of these embodiments, the first arm of the bell crank is connected to the ottoman link via the ottoman drive link. In further embodiments, the second arm of the bell crank is connected to the rear pivot link via a bell crank control link.

In some embodiments, the driving end of the linear actuator is connected to the ottoman drive link via a front motor drive tube.

A chair is also provided. The chair includes a seat member and a back member, an ottoman assembly configured to retract under the seat member in a closed position and deploy in an open position, a linkage assembly operatively connected to the ottoman assembly and including a front pivot link, a rear pivot link, and an ottoman drive link, and a linear actuator having a driving end operatively connected to the linkage assembly via the ottoman drive link, wherein the linear actuator is configured to extend to deploy the ottoman assembly to the open position by pushing the ottoman drive link forward and to contract to retract the ottoman assembly to the closed position by pulling the motor drive tube backward.

In some embodiments, the linkage assembly further includes an ottoman link connecting the linkage assembly to the ottoman assembly, the linear actuator actuating the ottoman link via the ottoman drive link.

In certain embodiments, the linkage assembly includes a seat rail, the front pivot link being pivotably connected to the front of the seat rail and the rear pivot link being rotatably connected to the rear of the seat rail. In some of these embodiments, the linkage assembly further includes a bell crank connected to the seat rail, a first arm of the bell crank mechanically connected to the ottoman link and a second arm of the bell crank mechanically connected to the rear pivot link. In some of these embodiments, the first arm of the bell crank is connected to the ottoman link via the ottoman drive link. In further embodiments, the second arm of the bell crank is connected to the rear pivot link via a bell crank control link.

In some embodiments, the driving end of the linear actuator is connected to the ottoman drive link via a front motor drive tube.

BRIEF DESCRIPTION OF THE DRAWINGS

Various advantages and features of the invention will be understood from the following detailed description taken in connection with the appended claims and with reference to the attached drawing figures in which:

DETAILED DESCRIPTION OF THE INVENTION

Figure 1A:
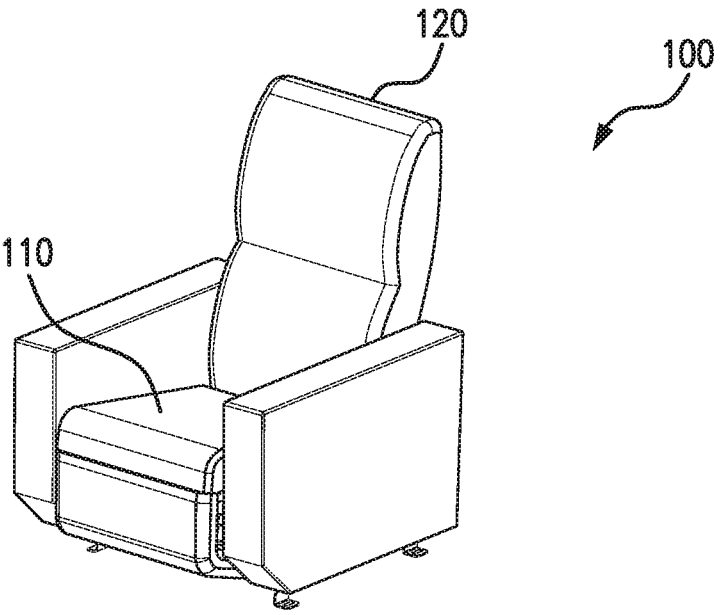
FIG. 1A illustrates a perspective view of an exemplary motion furniture comprising a mechanism for actuating the motion furniture between a first configuration and a second configuration in an example.
Figure 1B:
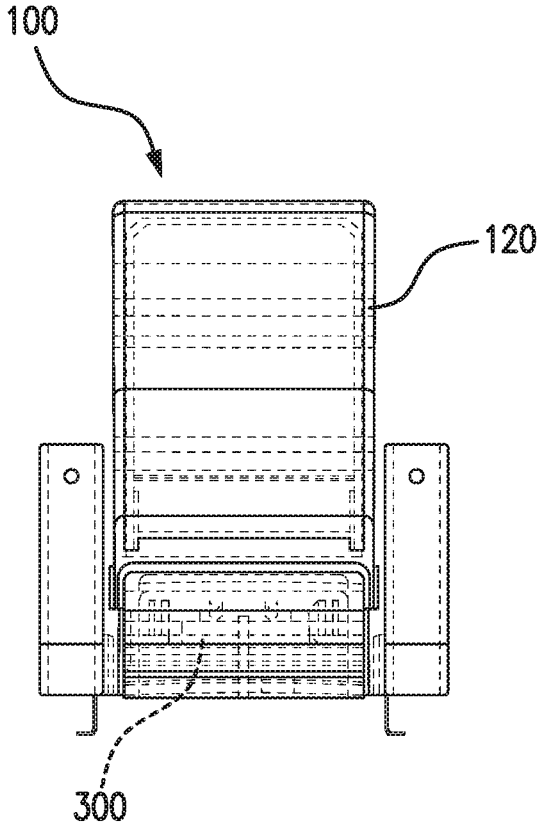
FIG. 1B illustrates a front view of an exemplary motion furniture comprising a mechanism for actuating the motion furniture between a first configuration and a second configuration in an example.
Figure 1C:
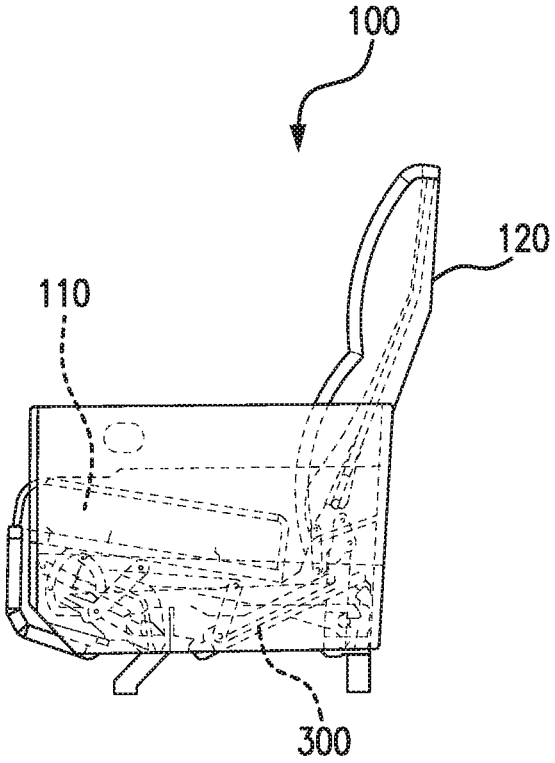
FIG. 1C illustrates a side view of an exemplary motion furniture comprising a mechanism for actuating the motion furniture between a first configuration and a second configuration in an example.
Figure 2A:
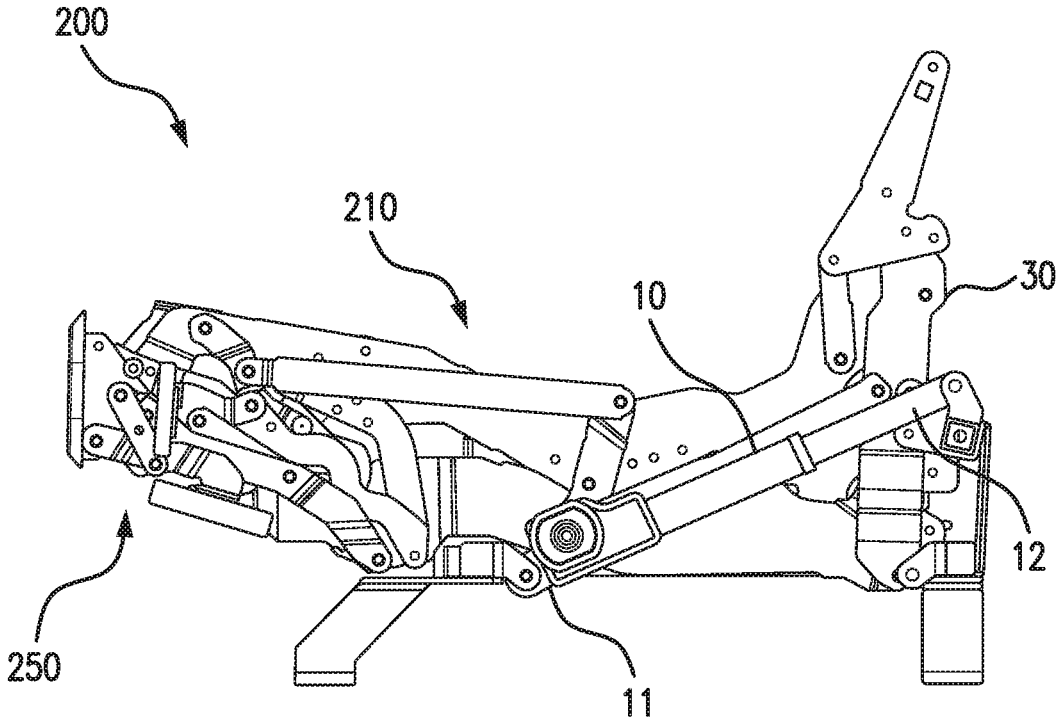
PRIOR ART FIG. 2A
FIG. 2A illustrates a closed position of a full assembly of an existing mechanism for actuating a motion furniture between a first configuration and a second configuration.
Figure 2B:
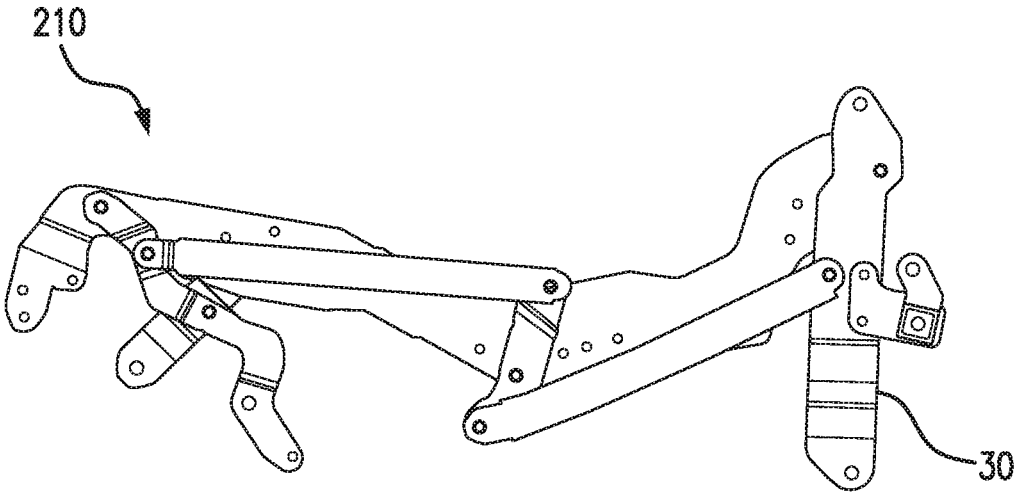
PRIOR ART FIG. 2B
FIG. 2B illustrates a closed position of a linkage assembly of the existing mechanism for actuating a motion furniture between a first configuration and a second configuration.
Figure 3A:
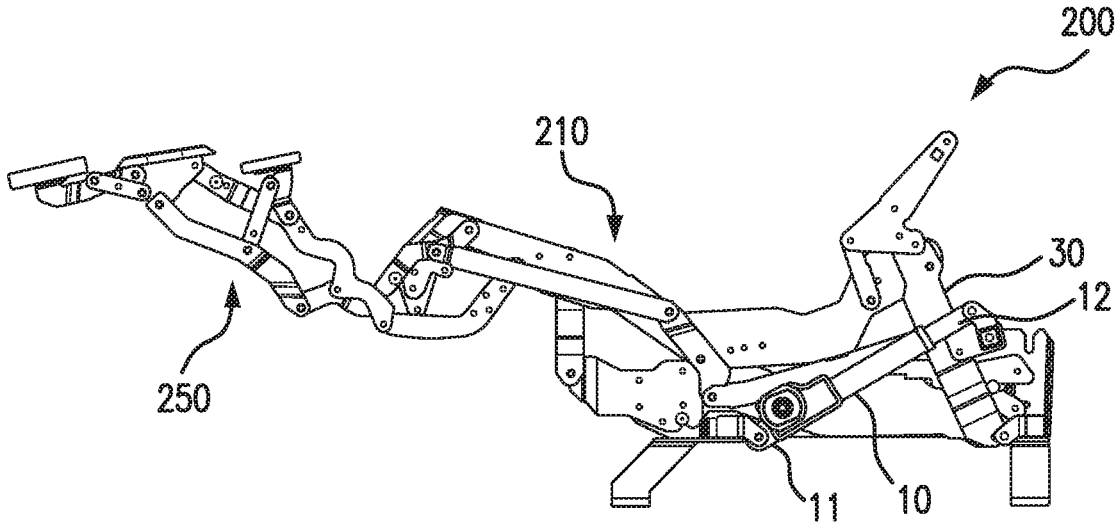
PRIOR ART FIG. 3A
FIG. 3A illustrates an open position of a full assembly of the existing mechanism for actuating a motion furniture between a first configuration and a second configuration.
Figure 3B:
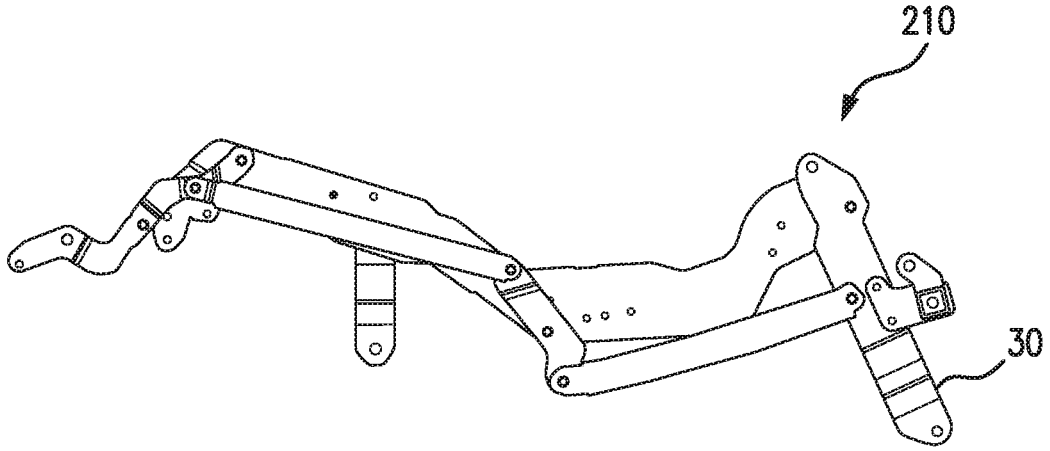
PRIOR ART FIG. 3B
FIG. 3B illustrates an open position of a linkage assembly of the existing mechanism without the actuator to provide a cleaner view of the open position of the existing mechanism.

Embodiments of the present invention disclose an improved mechanism for actuating a motion furniture between a first configuration and a second configuration. The disclosed mechanism may be employed in a motion furniture such as a reclining seat to drive the seat between an open position and a closed position, which may respectively correspond to the first configuration and the second configuration or vice versa, for example. An example of a reclining seat 100 comprising an embodiment of the improved mechanism 100 is depicted in FIGS. 1A-C. The reclining seat 200 comprises a seating member 110 and a back member 120. Such a reclining chair 100 can be used in living rooms or installed in movie theaters, for example. In some embodiments, the improved mechanism 300 of the present invention may be located below the seating member 110 and between the arms of the reclining chair 120. Embodiments of the present invention further disclose a method for actuating a motion furniture between a first configuration and a second configuration using the system as described herein.

Figure 4A:
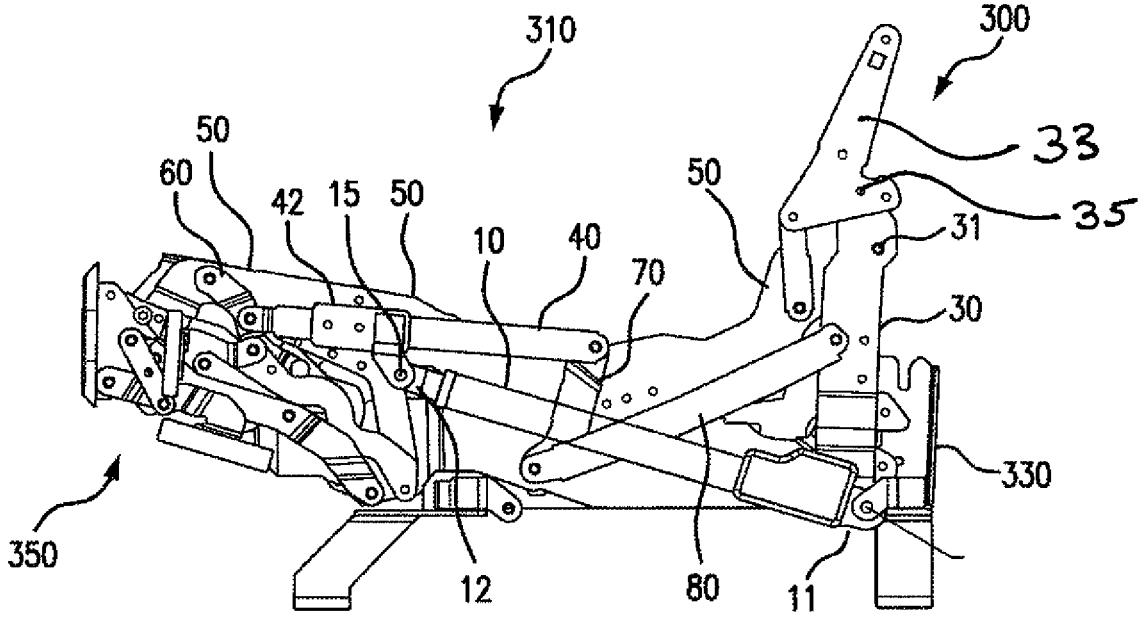
FIG. 4A illustrates a closed position of a full assembly of an improved mechanism for actuating a motion furniture between a first configuration and a second configuration in an example, according to an embodiment consistent with the principles described herein.

FIG. 4A illustrates a closed position of a full assembly of an improved mechanism 300 for actuating a motion furniture between a first configuration and a second configuration in an example, according to an embodiment consistent with the principles described herein. In this improved mechanism, the position of the actuator 10 with respect to the rest of the mechanism 300 differs from that of FIGS. 2A, 2B, 3A, and 3B. In particular, the base 11 of the actuator is attached to a fixed point near the rear pivot link 30, whereas the driving end 12 of the actuator 10 is connected at the point of attachment or driving point 15 to the front motor drive tube 42 on the ottoman drive link 40. Further, unlike the existing mechanism 200 of FIGS. 2A, 2B, 3A, and 3B, the linear actuator 10 of the improved mechanism 300 is contracted to place the improved mechanism 300 in the closed position. As previously discussed, the linear actuator 10 may be a mechanical actuator, an electrical actuator, a hydraulic actuator, or a pneumatic actuator, among other examples, including combination of the above (e.g., an electromechanical actuator).

Figure 4B:
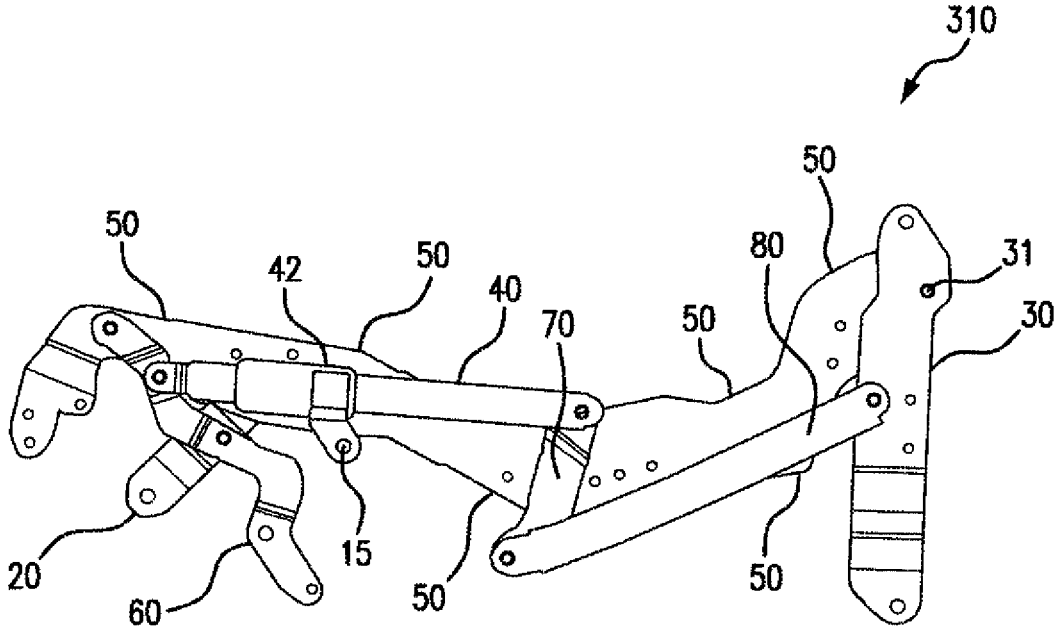
FIG. 4B illustrates a closed position of the linkage assembly for the improved mechanism for actuating a motion furniture between a first configuration and a second configuration in an example, according to an embodiment consistent with the principles described herein.

FIG. 4B illustrates a closed position of the linkage assembly 310 for the improved mechanism 300 for actuating a motion furniture between a first configuration and a second configuration in an example, according to an embodiment consistent with the principles described herein. The linkable assembly 310 is a set of inter-connected components that transmits the motion of the actuator 10 to an ottoman assembly 350 to deploy or retract the ottoman assembly 350. The linear actuator 10 is omitted to provide a cleaner view of the linkage assembly 310 and, in particular, of the connection points of the linear actuator 10 at the fixed point at the rear of the assembly (the base 11 of the actuator) and at the front motor drive tube 42 on the ottoman drive link 40 (the driving end 12 of the actuator), as previously described.

A further detailed description of the exemplary improved mechanism according to embodiments of the present invention as illustrated in FIGS. 4A and 4B will be provided. In some embodiments, a motion furniture 100 according to an embodiment of the present invention may comprise fixed base or chassis 330. The fixed base 330 may comprise one or more interconnected structural elements and is configured to serve as a support structure for various components of the motion furniture 100. The motion furniture 100 further comprises the improved mechanism 300 for actuating the furniture according to an embodiment of the present invention. The improved mechanism 300 may comprise a seat rail 50 (better illustrated in FIG. 4B where obstructing elements of the improved mechanism are omitted clarity). The seat rail 50 extends from the front of the seat member 110 of the motion furniture 100 to its back and provides structural support for various components of the improved mechanism 300. In particular, multiple components of the linkage assembly 210 are mounted to or are connected to the seat rail 50. In some embodiments, the seat rail 50 may comprise a single piece or component.

At the back end of the seat rail 50, a rear pivot link 30 is rotatably connected to the seat rail 50. The rear pivot link 30 connects at one end to the seat rail at connection point 31, and extends downward from the rail 50. The rear pivot link is also pivotally connected to a backrest actuator link 33 by means of a pivotal connection 35. The rear pivot link 30 is configured to rotate vertically alongside the rail 50 about the point of connection 31 to the rail 50 and in the longitudinal direction of the rail. The rear pivot link 30 may be connected to the rail 50 using a pivot pin or any other suitable means of achieving a pivotal connection. The opposite end of the rear pivot link 30 from the rail is connected to the fixed base 330, where it is also pivotably connected.

Figure 5A:
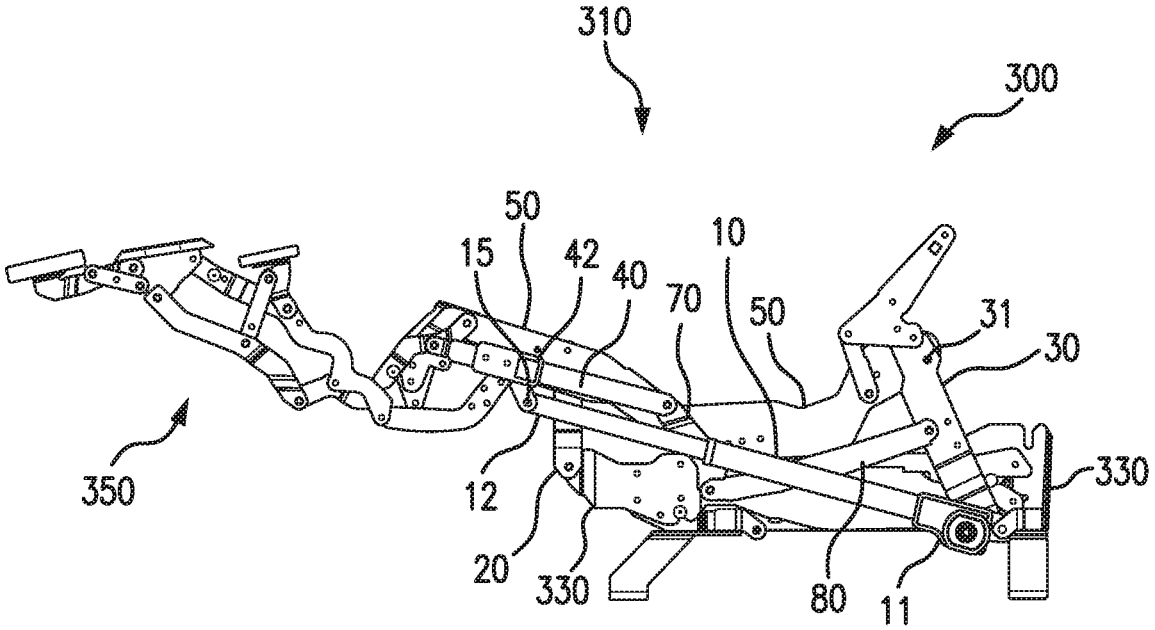
FIG. 5A illustrates an open position of a full assembly of an improved mechanism for actuating a motion furniture between a first configuration and a second configuration in an example, according to an embodiment consistent with the principles described herein.

Another pivot link (a front pivot link 20) is rotatably attached to the seat rail 50 toward the front end of the seat rail (the connection point in FIGS. 4A and 4B is obstructed by other components of the assembly). In some embodiments, the connection point between the seat real 50 and the front pivot link 20 may be at distance of approximately a quarter of the length of the seat rail from its front end. The front pivot link 20 also extends downward from the seat rail 50 and is configured to pivot vertically alongside the rail and in the longitudinal direction of the rail 50. The front pivot link 20 too may be attached to the seat rail 50 using a pivot pin or equivalent connector. Further, the opposite end of the front pivot link 20 is also pivotably attached to the front end of the fixed base or chassis 330 (as best shown in FIG. 5A where the ottoman assembly obstructing the view in FIG. 4A is deployed, providing a clear view of the attachment point to the fixed base 330). The seat rail 50 is thus connected to the fixed base 330 using the front pivot link 20 and the rear pivot link 30, each link being pivotably attached to the rail 50 at one end (top end) and the fixed base 330 at the other end (bottom end). The configuration enables the seat rail 50 to slide forward and back in relation to the fixed base 330.

The seat rail 50 connects to an ottoman assembly 350 via an ottoman link 60. The ottoman link 60 pivotably connects to the front end of the seat rail 50. Near the middle of the seat rail 50, a bell crank 70 is pivotably connected to the seat rail 50 using a connection pin or equivalent fastener. In the embodiment illustrated, the bell crank 70 is an elongated member and the pivot pin connects to the middle of the member but other configurations of bell cranks may be suitable. One arm of the bell crank 70 connects via a bell crank control link 80 to the rear pivot link 30. The bell crank control link 80 may be an elongated member pivotably connected at one end to an arm of the bell crank 70 and at the other end to a point near the middle of the rear pivot link 30. The bell crank control link 80 transmits the motion of the bell crank 70 to the rear pivot link 30 and vice versa. The other arm of the bell crank 70 connects to the ottoman link 60 via an ottoman drive link 40. The ottoman drive link 40 is an elongated member that pivotably connects to the bell crank 70 at one end and the ottoman link 60 at the other end. Thus, the bell crank's motion is also transmitted to the ottoman link 60 and vice versa.

As previously described, the driving end 12 of the linear actuator 10 is connected to the front drive motor tube 42, which is connected to the ottoman drive link 40. When the linear actuator 10 is retracted as illustrated in FIGS. 4A and 4B, the front motor drive tube 42 is pulled backward by the actuator 10 via the driving point 15, thus pulling the ottoman link 60 back to retract the assembly 300.

Figure 5B:
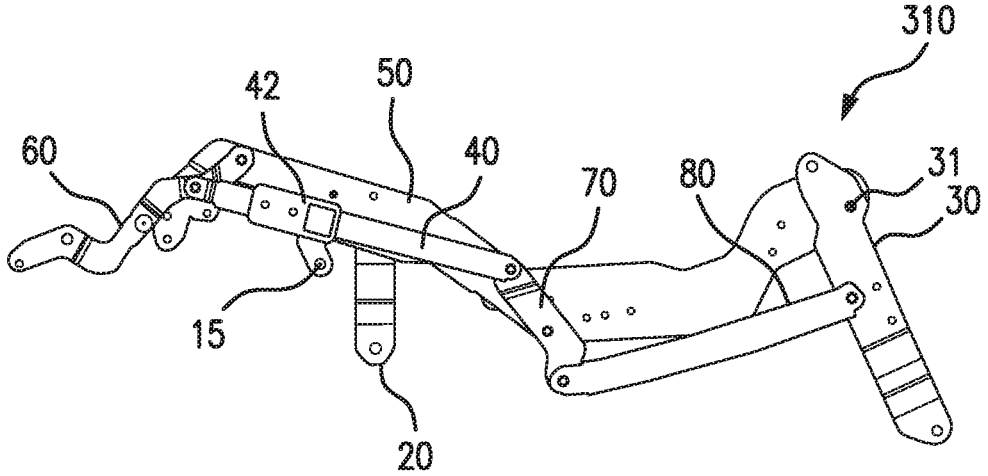
FIG. 5B illustrates an open position of a linkage assembly of the improved mechanism without the actuator to provide a cleaner view of the open position, according to an embodiment consistent with the principles described herein.

FIG. 5A illustrates an open position of a full assembly of an improved mechanism 300 for actuating a motion furniture between a first configuration and a second configuration in an example, according to an embodiment consistent with the principles described herein. Here, the linear actuator 10 is extended to open the assembly 300. In particular, as the driving end 12 of the linear actuator 10 translates toward the front of the assembly, the driving point 15 to which the driving end 12 of the actuator 10 is attached is pushed toward the same direction, causing the improved assembly to deploy open. In particular, the ottoman drive link 40 pushes the ottoman link 60 forward and causes it to rotate toward the front to deploy the retracted ottoman assembly 350. FIG. 5B illustrates an open position of a linkage assembly 310 of the improved mechanism 300 without the actuator 10 to provide a cleaner view of the open position, according to an embodiment consistent with the principles described herein. Thus, in the improved mechanism 300 of the present invention, the linear actuator 10 controls the motion of the ottoman drive link 40 such that the linear actuator 10 is fully contracted when the mechanism is in the closed position. Conversely, the linear actuator 10 is extended when the mechanism is in the open position.

The improved mechanism 300 for actuating a motion furniture between a first configuration and a second configuration disclosed herein provides the advantage of improving the drive characteristic of the mechanism by controlling the linkage 310 closer to the center of the linkage arrangement. Further, the improved mechanism 300 may significantly decrease the electrical load on the linear actuator 10, thereby providing power savings and improving the longevity of the actuator 10, as well as the improved mechanism 300, among other advantages.

It should be understood that combinations of described features or steps are contemplated even if they are not described directly together or not in the same context.

It should be understood that claims that include fewer limitations, broader claims, such as claims without requiring a certain feature or process step in the appended claim or in the specification, clarifications to the claim elements, different combinations, and alternative implementations based on the specification, or different uses, are also contemplated by the embodiments of the present invention.

The terms or words that are used herein are directed to those of ordinary skill in the art in this field of technology and the meaning of those terms or words will be understood from terminology used in that field or can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

It should be understood that the above-described examples are merely illustrative of some of the many specific examples that represent the principles described herein. Clearly, those skilled in the art can readily devise numerous other arrangements without departing from the scope as defined by the following claims.

We claim:

1. A mechanism for actuating a motion furniture comprising:

a chassis assembly;

a linkage assembly operatively connected to said chassis assembly via a front pivot link, a backrest actuator link, a rear pivot link having a first end connected directly to said chassis and a second end connected directly to said backrest actuator link, and an ottoman drive link operatively connected to an ottoman assembly; and a linear actuator having a base end connected to a rear end portion of said chassis, and a driving end operatively connected to said linkage assembly via said ottoman drive link, whereby as said linear actuator is actuated so as to be extended, said driving end of said linear actuator will drive said ottoman drive link forwardly and will cause said backrest actuator link to move backwardly, whereas, conversely, as said linear actuator is actuated so as to be contracted, said linear actuator will cause said ottoman drive link to move backwardly while said backrest actuator link is moved forwardly.

2. The mechanism of claim 1, wherein:

said linkage assembly is operatively coupled to an ottoman assembly so as to move said ottoman assembly to a closed position when said linear actuator moves said ottoman drive link backwardly, and to move said ottoman assembly to an open position when said linear actuator moves said ottoman drive link forwardly.

3. The mechanism of claim 2, wherein:

said linkage assembly further comprises an ottoman link connecting said linkage assembly to said ottoman assembly such that said linear actuator actuates said ottoman link via said ottoman drive link.

4. The mechanism of claim 3, wherein:

said linkage assembly comprises a seat rail;

said front pivot link is pivotally connected to a front portion of said seat rail; and said rear pivot link is pivotally connected to a rear portion of said seat rail.

5. The mechanism of claim 4, wherein:

said linkage assembly further comprises a bell crank pivotally mounted upon said seat rail;

a first arm of said bell crank being operatively connected to said ottoman link; and a second arm of said bell crank being operatively connected to said rear pivot link.

6. The mechanism of claim 5, wherein:

said first arm of said bell crank is operatively connected to said ottoman link via said ottoman drive link.

7. The mechanism of claim 5, wherein:

said second arm of said bell crank is operatively connected to said rear pivot link via a bell crank control link.

8. The mechanism of claim 1, wherein:

said driving end of said linear actuator is operatively connected to said ottoman drive link via a front motor drive tube.

9. A chair comprising:

a seat member, a chassis assembly, and a back member;

an ottoman assembly movable between a closed position at which said ottoman assembly is retracted so as to be disposed beneath said seat member, and an open position at which said ottoman assembly is extended so as to be disposed forwardly of said seat member;

a linkage assembly operatively connected to said chassis assembly via a front pivot link, a seat rail supporting said seat member, a backrest actuator link operatively connected to said seat rail for moving said back member, a rear pivot link having a first end connected directly to said chassis and a second end connected directly to said backrest actuator link, and an ottoman drive link operatively connected to said ottoman assembly; and a linear actuator having a driving end operatively connected to said linkage assembly via said ottoman drive link, whereby as said linear actuator is actuated so as to be extended, said driving end of said linear actuator will drive said ottoman drive link forwardly so as to move said ottoman assembly forwardly while said back member is moved backwardly, whereas, conversely, as said linear actuator is actuated so as to be contracted, said linear actuator will pull said ottoman drive link backwardly so as to return said ottoman assembly to said retracted position beneath said seat while said back member is moved forwardly.

10. The chair of claim 9, wherein:

said linkage assembly further comprises an ottoman link connecting said linkage assembly to said ottoman assembly such that said linear actuator actuates said ottoman link via said ottoman drive link.

11. The chair of claim 9, wherein:

said linkage assembly comprises said seat rail;

said front pivot link is pivotally connected to a front portion of said seat rail; and said rear pivot link is pivotally connected to a rear portion of said seat rail.

12. The chair of claim 11, wherein:

said linkage assembly further comprises a bell crank pivotally mounted upon said seat rail;

a first arm of said bell crank being operatively connected to said ottoman link; and a second arm of said bell crank being operatively connected to said rear pivot link.

13. The chair of claim 12, wherein:

said first arm of said bell crank is operatively connected to said ottoman link via said ottoman drive link.

14. The chair of claim 12, wherein:

said second arm of said bell crank is operatively connected to said rear pivot link via a bell crank control link.

15. The chair of claim 9, wherein:

said driving end of said linear actuator is operatively connected to said ottoman drive link via a front motor drive tube.

* * * * *